US012680175B2

(12) United States Patent
Oh et al.

(10) Patent No.: US 12,680,175 B2
(45) Date of Patent: Jul. 14, 2026

(54) HYDROGEN-OXYGEN MIXTURE GAS PRODUCING AND SUPPLYING DEVICE

(71) Applicants: Young Han Oh, Dangjin-si (KR); Mal Soon Shin, Busan (KR); H2TUBE CO., LTD., Cheongju-si (KR)

(72) Inventors: Young Han Oh, Dangjin-si (KR); Mal Soon Shin, Busan (KR)

(73) Assignees: Young Han Oh (KR); Mal Soon Shin (KR); H2TUBE CO., LTD. (KR)

( * ) Notice: Subject to any disclaimer, the term of this patent is extended or adjusted under 35 U.S.C. 154(b) by 737 days.

(21) Appl. No.: 18/094,517

(22) Filed: Jan. 9, 2023

(65) Prior Publication Data

US 2024/0093385 A1 Mar. 21, 2024

(30) Foreign Application Priority Data

Sep. 15, 2022 (KR) ..... 10-2022-0116253

(51) Int. Cl.

| | |
|---|---|
| ***C25B 1/044*** | (2021.01) |
| ***C25B 9/07*** | (2021.01) |
| ***C25B 9/17*** | (2021.01) |
| ***C25B 9/65*** | (2021.01) |
| ***C25B 11/02*** | (2021.01) |
| ***C25B 15/02*** | (2021.01) |

(52) U.S. Cl.

CPC ..... *C25B 1/044* (2021.01); *C25B 9/07* (2021.01); *C25B 9/17* (2021.01); *C25B 9/65* (2021.01); *C25B 11/02* (2013.01); *C25B 15/02* (2013.01)

(58) Field of Classification Search

CPC .. C25B 1/044; C25B 9/07; C25B 9/63; C25B 9/65; C25B 11/02

See application file for complete search history.

(56) References Cited

U.S. PATENT DOCUMENTS 4,113,601 A * 9/1978 Spirig ..... C25B 1/04 204/272
7,258,779 B2 * 8/2007 Casey ..... C25B 9/05 205/744
10,907,260 B1 * 2/2021 Warner ..... F02M 25/12

(Continued)

FOREIGN PATENT DOCUMENTS

GB 282688 A * 6/1929 ..... C25B 9/17
JP 2017221895 A * 12/2017

OTHER PUBLICATIONS

Machine translation of JP2017221895 of Tanaka et al. (Year: 2017).*

*Primary Examiner* — Brian W Cohen

(74) *Attorney, Agent, or Firm* — Park & Associates IP Law Office

(57) ABSTRACT

The present invention relates to a hydrogen-oxygen mixture gas producing and supplying device that includes: a hydrogen-oxygen mixture gas generation water tank to store a given amount of water; a top cover to supply the water to the hydrogen-oxygen mixture gas generation water tank; a bottom cover mounted on bottom of the hydrogen-oxygen mixture gas generation water tank and a bottom sealing plate for sealing the bottom of the extension cylinder to form an installation space; a hydrogen-oxygen mixture gas producer to produce hydrogen ($H_2$) and oxygen ($O_2$); and a water level control sensor to notify a user of the shortage of water.

9 Claims, 16 Drawing Sheets

(56) References Cited

U.S. PATENT DOCUMENTS

| | | | | |
|---|---|---|---|---|
| 2009/0139856 | A1* | 6/2009 | Chiarini, Jr. | C25B 1/044 204/272 |
| 2010/0320083 | A1* | 12/2010 | Seratt | C25B 1/04 204/278 |
| 2017/0211192 | A1* | 7/2017 | Bozhilov | C25B 15/08 |

* cited by examiner

HYDROGEN-OXYGEN MIXTURE GAS PRODUCING AND SUPPLYING DEVICE

REFERENCE TO RELATED APPLICATIONS

This application claims the priority benefit of Korean Patent Application No. 10-2022-0116253 filed on Sep. 15, 2022, the entire contents of which are incorporated herein by reference.

FIELD OF THE INVENTION

The present invention relates to a hydrogen-oxygen mixture gas producing and supplying device, and more specifically, to a hydrogen-oxygen mixture gas producing and supplying device that is capable of allowing electrolysis areas of positive (+) and negative (−) electrode plates for electrolyzing water to be enlarged to thus increase electrolysis of water, so that a mixed gas is produced by mixing hydrogen ($H_2$) and oxygen ($O_2$) as flammable gases produced to the form of fine air bubbles by the electrolysis of water and thus supplied to an automobile engine or a combustion chamber of a fuel ignition burner.

BACKGROUND OF THE INVENTION

If water is electrolyzed, generally, it is decomposed into hydrogen ($H_2$) and oxygen ($O_2$), and in this case, the hydrogen and oxygen are molecular flammable gases.

Accordingly, many studies and development of the utilization of hydrogen as the flammable gas as a fuel have to be required.

A conventional technology related to a flammable hydrogen gas generator is disclosed in Korean Patent No. 10-2077059. According to the conventional technology, water is electrolyzed to splittingly exhaust a gas and hydrogen water generated from a cathode and a gas and oxygen water generated from an anode, so that they can be conveniently used. However, the conventional technology has many difficulties in collectively producing the flammable hydrogen gas available as a fuel.

Another conventional technology is disclosed in Korean Patent Application Laid-open No. 10-2005-0006005 (Dated Jan. 15, 2005) entitled "Alcohol-mixed fuel additive for automobile engine", but the conventional technology suggests the alcohol-mixed fuel additive that has ethanol as a main material to provide low metal corrosion and complete combustion, thereby reducing an amount of exhaust gas to the maximum.

However, fuel additives have been already introduced to various forms of oxygen-contained additives for hydrocarbon-based fuel so as to increase power and acceleration of a spark-ignition engine of an automobile, and as the hydrocarbon-based fuel includes alcohol, ether, and ketone, it may have bad influences on the durability of the engine and the parts therein.

SUMMARY OF THE INVENTION

Accordingly, the present invention has been made to solve the above-mentioned problems occurring in the related art, and it is an object of the present invention to provide a hydrogen-oxygen mixture gas producing and supplying device that is capable of producing hydrogen and oxygen ions as flammable gases available as a fuel through electrolysis of water and thus supplying a hydrogen-oxygen mixture gas to an automobile engine or a combustion chamber of a fuel ignition burner, thereby helping the fuel burnt completely, improving the power of engine, and reducing generation of smoke.

To accomplish the above-mentioned objects, according to the present invention, a hydrogen-oxygen mixture gas producing and supplying device may include: a hydrogen-oxygen mixture gas generation water tank closed on top and bottom thereof to store a given amount of water therein and adapted to locate positive and negative electrode plates adapted to electrolyze the water using positive and negative currents supplied from the outside therein; a top cover mounted on top of the hydrogen-oxygen mixture gas generation water tank to open and close the top of the hydrogen-oxygen mixture gas generation water tank and having a water inlet pipe screw-coupled thereto and openable and closeable by means of a stopper to supply the water to the hydrogen-oxygen mixture gas generation water tank; a bottom cover mounted on bottom of the hydrogen-oxygen mixture gas generation water tank to open and close the bottom of the hydrogen-oxygen mixture gas generation water tank and having an extension cylinder extending from the outer periphery thereof and a bottom sealing plate for sealing the bottom of the extension cylinder to form an installation space in which a power supply and control part is mounted to apply the positive and negative currents to the positive and negative electrode plates; a hydrogen-oxygen mixture gas producer fixedly supported vertically to the bottom cover inside the hydrogen-oxygen mixture gas generation water tank, while being submerged in the water stored in the hydrogen-oxygen mixture gas generation water tank, and having the positive and negative electrode plates alternately laminated on top of one another, while having a given distance vertically, to perform electrolysis for the water stored in the hydrogen-oxygen mixture gas generation water tank, with the positive current applied from a long bolt to which the positive current is applied from the power supply and control part and the negative current applied from a long bolt to which the negative current is applied from the power supply and control part, and to thus produce hydrogen ($H_2$) and oxygen ($O_2$); and a water level control sensor part adapted to allow a warning sound to be generated or to allow an LED blinking lamp to operate, when the storage level of the water stored in the hydrogen-oxygen mixture gas generation water tank is lower than top of the hydrogen-oxygen mixture gas producer, so as to notify a user of the shortage of water.

According to the present invention, desirably, the plurality of positive and negative electrode plates each may have the sectional area of the shape of "/\" or "\/" between an outer periphery and a center opening and a plurality of round bent portions continuously formed concentrically between the outer periphery and the center opening at given intervals so as to enlarge an electrolysis area.

According to the present invention, desirably, the top cover of the hydrogen-oxygen mixture gas generation water tank may include a hydrogen-oxygen mixture gas outlet pipe protruding outward therefrom to exhaust the hydrogen-oxygen mixture gas produced in the form of fine air bubbles, through the electrolysis operation of the plurality of positive and negative electrode plates laminated on top of one another in the hydrogen-oxygen mixture gas producer, while having the given distance vertically.

According to the present invention, desirably, the power supply and control part may include a power connection terminal fixed exposedly to one side of the extension cylinder of the bottom cover, a power plug connected to an electrical outlet to receive power from the outside, a connection wire connected to the power plug, and a connection socket disposed on end of the connection wire, so that the power received from the outside is applied to the power supply and control part disposed inside the installation space.

According to the present invention, desirably, the device may further include a plurality of permanent magnets built spaced apart from each other by a given distance in the underside of the bottom cover adapted to close the bottom of the hydrogen-oxygen mixture gas generation water tank so as to allow magnetic fields generated therefrom to flow to the water stored in the hydrogen-oxygen mixture gas generation water tank.

According to the present invention, desirably, the hydrogen-oxygen mixture gas producer may include a plurality of fixing flanges protruding symmetrically from each electrode plate, top and bottom support plates, and four long bolts passing through the four corners of the top and bottom support plates and screw-coupled to the top and bottom support plates, and the two long bolts of the four long bolts may pass through the bottom cover and enter the installation space, whereas the remaining long bolts may be supported against top of the bottom cover or fitted to concave grooves formed to a given depth on top of the bottom cover.

According to the present invention, desirably, the plurality of positive and negative electrode plates may have the sectional area of the shape of "/\" or "\/" and the plurality of fixing flanges protruding symmetrically from the outer periphery, and in a state where the long bolt passes through the fixing flanges protruding from the plurality of positive electrode plates, the bottom end of the long bolt may be connected to a positive connection terminal for applying the positive current, whereas in a state where the long bolt may pass through the fixing flanges protruding from the plurality of negative electrode plates, the bottom end of the long bolt may be connected to a negative connection terminal for applying the negative current.

According to the present invention, desirably, the power supply and control part may be disposed in the installation space formed under the bottom cover screw-coupled to the bottom of the hydrogen-oxygen mixture gas generation water tank, the water level control sensor part may be electrically connected to the power supply and control part and adapted to sense whether the storage level of the water stored in the hydrogen-oxygen mixture gas generation water tank is lower than top of the hydrogen-oxygen mixture gas producer, and a warning part may be mounted inside the installation space to generate the warning sound or operate the LED blinking lamp according to the sensed result.

According to the present invention, desirably, the hydrogen-oxygen mixture gas producer may include a plurality of cover plates fixedly attached to the four sides thereof to hide the plurality of positive and negative electrode plates laminated on top of one another while having the given distances from one another vertically from the outside and to provide advertising printing surfaces thereon to represent all kinds of explanations or advertising words or drawings.

According to the present invention, the hydrogen-oxygen mixture gas producing and supplying device is configured to allow the hydrogen-oxygen mixture gas producer fixedly disposed vertically on the bottom cover of the transparent water tank to have the positive electrode plates and the negative electrode plates alternately laminated on top of one another, while having the given distance in up and down directions, so as to apply the positive current and the negative current of the power received from the outside to the positive electrode plates and the negative electrode plates, so that through the electrolysis of the electrode plates, the hydrogen and oxygen as flammable gases to the form of fine air bubbles are produced and supplied to the combustion chambers of the automobile engine through the intake manifold or to the combustion chamber of the fuel ignition burner, together with air, thereby achieving complete combustion to improve the rate of fuel consumption and the engine power and to reduce the noise and smoke.

In addition, the hydrogen-oxygen mixture gas producing and supplying device is configured to allow small, medium, and large-sized hydrogen-oxygen mixture gas producers to be appropriately selected according to the capacities or performance of gasoline engines or diesel engines of all types of automobiles or the capacities or performance of the fuel ignition burners, thereby improving the engine performance of the automobile and the combustion efficiency of the burner.

DETAILED DESCRIPTION OF THE INVENTION

Figure 1:
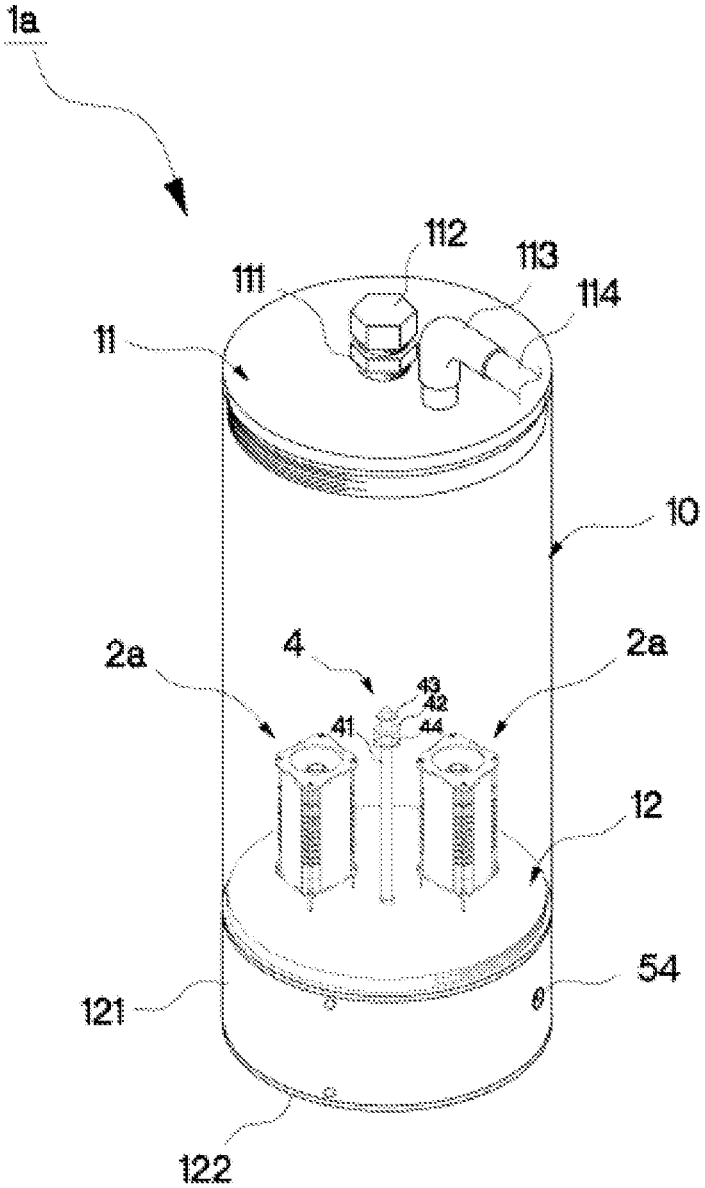
FIG. 1 is a perspective view showing a hydrogen-oxygen mixture gas producing and supplying device according to a first embodiment of the present invention.

Hereinafter, an explanation of a configuration and operation of a hydrogen-oxygen mixture gas producing and supplying device according to the present invention will be given in detail with reference to the attached drawings.

In the description, the thicknesses of the lines or the sizes of the components shown in the drawing may be magnified for the clarity and convenience of the description. Further, the corresponding parts in the embodiments of the present invention are indicated by corresponding reference numerals and the repeated explanation on the corresponding parts will be avoided.

Figure 2:
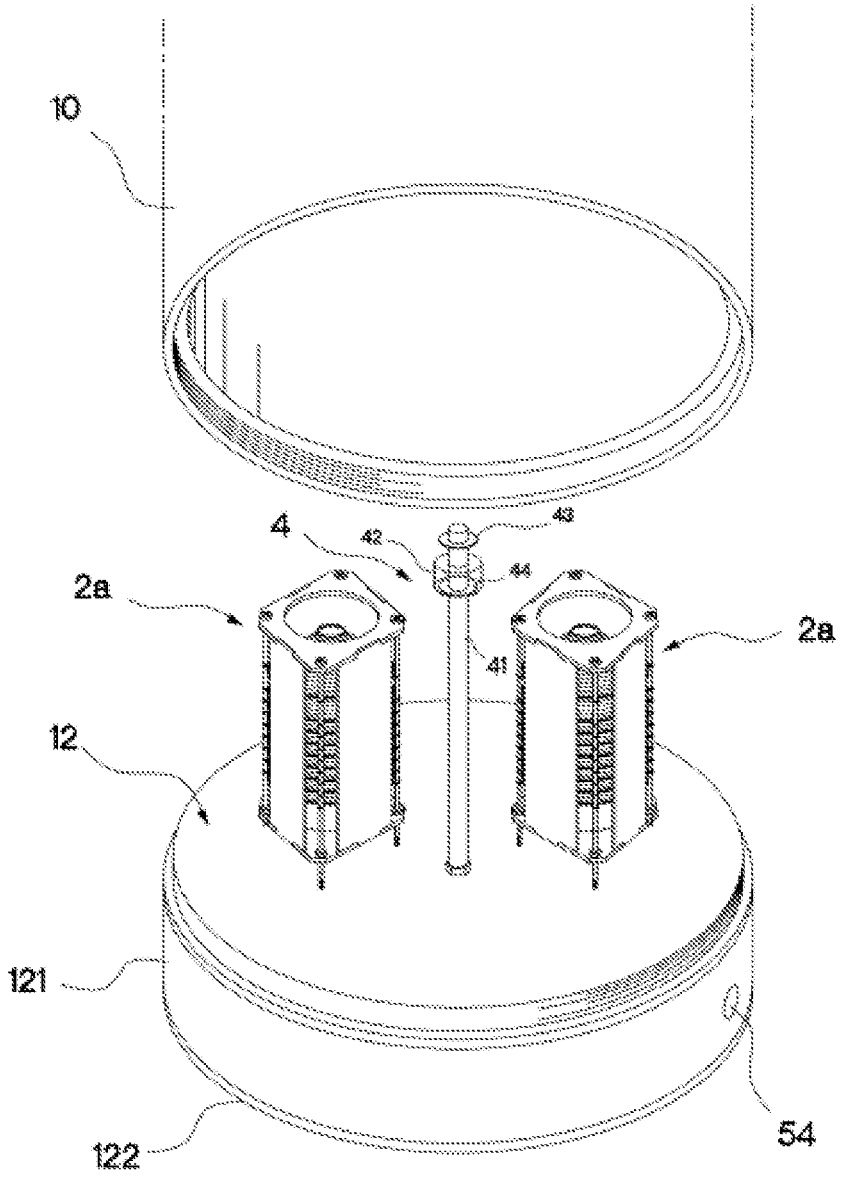
FIG. 2 is a perspective view showing a plurality of hydrogen-oxygen mixture gas producers separated from a hydrogen-oxygen mixture gas generation water tank of the device according to the first embodiment of the present invention.
Figure 3:
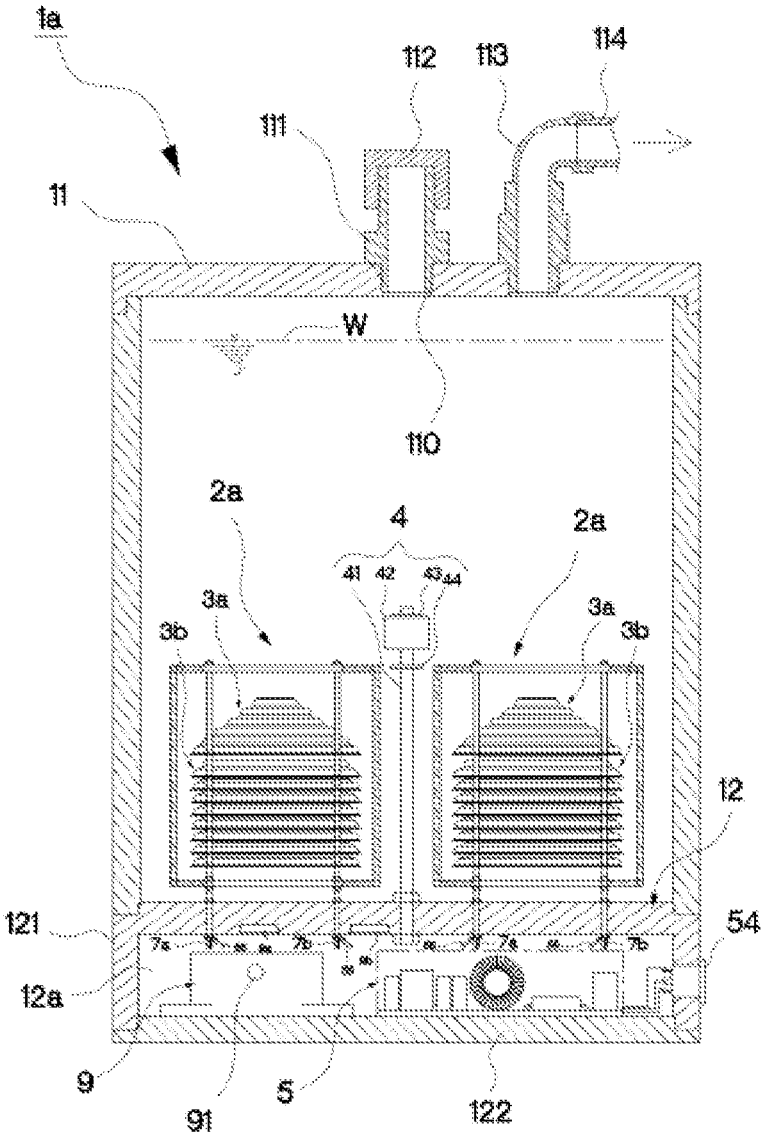
FIG. 3 is a sectional view showing the hydrogen-oxygen mixture gas producing and supplying device according to the first embodiment of the present invention.

FIG. 1 is a perspective view showing a hydrogen-oxygen mixture gas producing and supplying device 1*a* according to a first embodiment of the present invention, FIG. 2 is a perspective view showing a plurality of hydrogen-oxygen mixture gas producers 2*a* of the hydrogen-oxygen mixture gas producing and supplying device 1*a* according to the first embodiment of the present invention, and FIG. 3 is a sectional view showing the hydrogen-oxygen mixture gas producing and supplying device 1*a* according to the first embodiment of the present invention.

According to the first embodiment of the present invention, the hydrogen-oxygen mixture gas producing and supplying device 1*a* is configured to have a hydrogen-oxygen mixture gas generation water tank 10 made of a synthetic resin or stainless steel and the plurality of hydrogen-oxygen mixture gas producers 2*a* fixedly disposed inside the hydrogen-oxygen mixture gas generation water tank 10, so that water is full in the hydrogen-oxygen mixture gas generation water tank 10 and then electrolyzed to produce and supply a mixed gas of hydrogen ($H_2$) and oxygen ($O_2$) as flammable gases.

To do this, the hydrogen-oxygen mixture gas producing and supplying device 1*a* includes: the hydrogen-oxygen mixture gas generation water tank 10; a top cover 11 sealingly mounted on top of the hydrogen-oxygen mixture gas generation water tank 10; a bottom cover 12 closingly mounted on bottom of the hydrogen-oxygen mixture gas generation water tank 10; the plurality of hydrogen-oxygen mixture gas producers 2*a* fixedly disposed vertically inside the hydrogen-oxygen mixture gas generation water tank 10, while being supported against the bottom cover 12; a water level sensor part 4 fixedly disposed vertically on the bottom cover 12 like the plurality of hydrogen-oxygen mixture gas producers 2*a* to notify a user of water refill time so that the water stored in the hydrogen-oxygen mixture gas generation water tank 10 has a storage level W with respect to top support plates 6*a* of the plurality of hydrogen-oxygen mixture gas producers 2*a*; and a power supply and control part 5 mounted in an installation space 12*a* formed inside the bottom cover 12 to supply and control the power received from the outside to the plurality of hydrogen-oxygen mixture gas producers 2*a* and the water level sensor part 4.

Further, the power supply and control part 5 is equipped with an electric machine (e.g., volume knob) for adjusting and supplying electric current (ampere) in supplying the positive (+) current and negative (−) current of the power received from the outside to a plurality of positive and negative electrode plates 3*a* and 3*b* constituting each hydrogen-oxygen mixture gas producer 2*a*.

The top cover 11 and the bottom cover 12 are detachably mounted onto the top and bottom of the hydrogen-oxygen mixture gas generation water tank 10 by means of screw fastening, so that the components inside the hydrogen-oxygen mixture gas generation water tank 10 can be well managed and repaired.

Each hydrogen-oxygen mixture gas producer 2*a* has the plurality of positive and negative electrode plates 3*a* and 3*b* adapted to electrolyze the water stored in the hydrogen-oxygen mixture gas generation water tank 10 and thus produce hydrogen and oxygen to the form of fine air bubbles, and each electrode plate has a sectional area bent to the shape of "∧" or "∨" and a plurality of round bent portions 30 formed concentrically to the form of stairs so as to increase an electrolysis area, so that the production of the hydrogen and oxygen can be increased. Further, the plurality of positive and negative electrode plates 3*a* and 3*b* are laminated alternately on top of one another, while having a given distance from one another.

The top cover 11 of the hydrogen-oxygen mixture gas producing and supplying device 1*a* has a water inlet pipe 111 openably and closably screw-coupled thereto to supply water to the hydrogen-oxygen mixture gas generation water tank 10. In this case, the water inlet pipe 111 is screw-coupled to a water inlet 110 formed on the top cover 11, and further, the water inlet pipe 111 is openable and closable by a stopper 112 screw-coupled thereto.

Further, the top cover 11 has a hydrogen-oxygen mixture gas outlet pipe 113 protruding outward therefrom to exhaust the hydrogen-oxygen mixture gas produced by separating hydrogen and oxygen as flammable gases in the form of fine air bubbles from water molecules ($H_2O$) through the water electrolysis operation of the hydrogen-oxygen mixture gas producers 2*a*.

The hydrogen-oxygen mixture gas outlet pipe 113 is connected to a hydrogen-oxygen mixture gas supply hose 114 adapted to supply the hydrogen-oxygen mixture gas exhausted from the hydrogen-oxygen mixture gas generation water tank 10 by means of the electrolysis to an intake manifold (not shown) connected to each combustion chamber of an automobile engine or a combustion chamber (not shown) of a fuel ignition burner (See FIG. 1).

Further, the bottom cover 12 is screw-coupled to the bottom of the hydrogen-oxygen mixture gas generation water tank 10 and includes an extension cylinder 121 extending from the outer periphery thereof and a bottom sealing plate 122 for sealing the bottom of the extension cylinder 121 to form the installation space 12*a* in which the power supply and control part 5 is mounted to supply and control the power to the hydrogen-oxygen mixture gas producers 2*a*.

The power supply and control part 5 includes a power plug 51 connected to an electrical outlet (not shown) to receive power from the outside, a connection wire 52 connected to the power plug 51, and a connection socket 53 disposed on end of the connection wire 52. Further, the extension cylinder 121 of the bottom cover 12 has a power connection terminal 54 fixed exposedly to one side thereof and connected to the connection socket 53 disposed on the end of the connection wire 52 of the power plug 51. The power connection terminal 54 is electrically connected to the power supply and control part 5 so as to supply the power applied from the power plug 51 to the power supply and control part 5.

Figure 15:
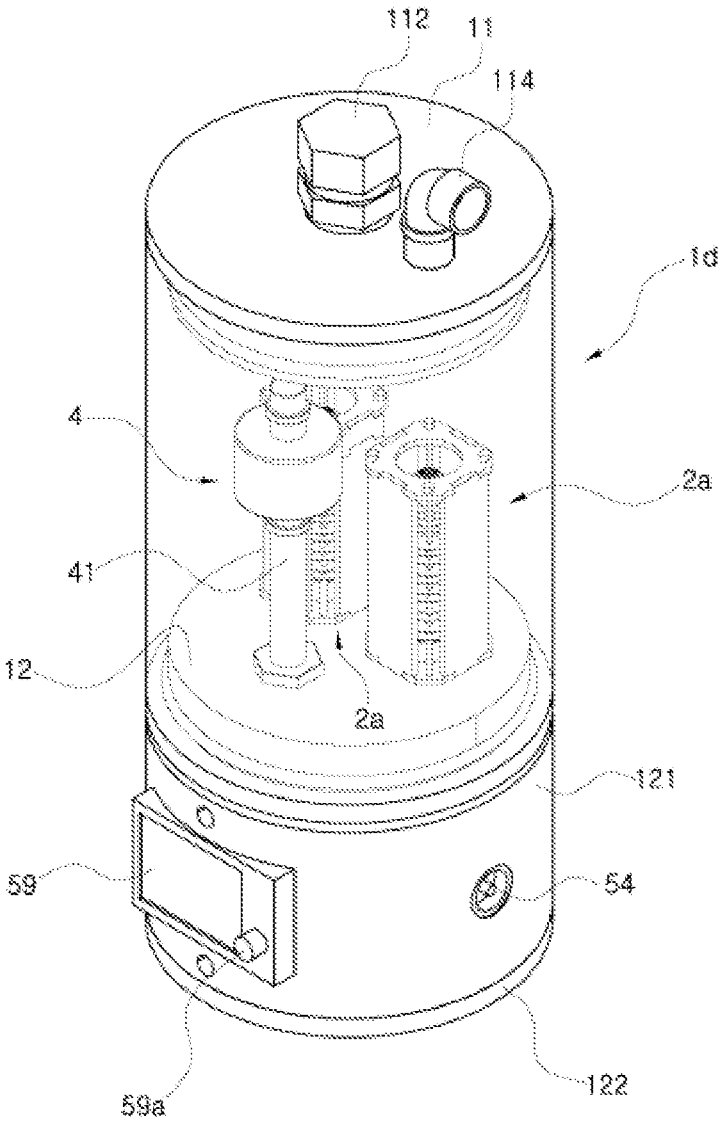
FIG. 15 is a perspective view showing a hydrogen-oxygen mixture gas producing and supplying device having two hydrogen-oxygen mixture gas producers and an external display panel mounted on the lower portion thereof and having a volume knob for current control according to a fourth embodiment of the present invention.

The power supply and control part 5 is configured to the form of a printed circuit board on which all kinds of electronic parts are mounted to perform power supply and control, and further, the power supply and control part 5 has an external display panel 59 with an electric current control part (volume knob) 59*a* mounted thereon to adjust the electric current of the power received from the outside appropriately, so that the electric current as designed is always outputted constantly irrespective of the size of electric current received from the outside, or an appropriate amount of hydrogen-oxygen mixture gas corresponding to the size or displacement of the automobile is supplied (See FIGS. 3 and 15).

As shown in FIGS. 9 to 12, each hydrogen-oxygen mixture gas producer 2*a* of the hydrogen-oxygen mixture gas producing and supplying device 1*a* includes: top and bottom support plates 6*a* and 6*b*; four long bolts 7*a*, 7*b*, 7*c*, and 7*d* passing through the four corners of the top and bottom support plates 6*a* and 6*b* and screw-coupled to the top and bottom support plates 6*a* and 6*b*; the plurality of positive electrode plates 3*a* and the plurality of negative electrode plates 3*b*, each having the sectional area of the shape of "/\" in which it becomes narrow toward the top and wide toward the bottom or having the sectional area of the shape of "\/" in which it becomes wide toward the top and narrow toward the bottom, alternately laminatedly coupled to the four long bolts 7*a*, 7*b*, 7*c*, and 7*d*, while having a given distance vertically in up and down directions, each electrode plate having an outer periphery 31 and a center opening 32; and a plurality of fixing flanges 33 and 34 disposed symmetrically on each electrode plate to allow the four long bolts 7*a*, 7*b*, 7*c*, and 7*d* to pass therethrough so that the positive electrode plates 3*a* and the negative electrode plates 3*b* can be supported against the four long bolts 7*a*, 7*b*, 7*c*, and 7*d*. In this case, as shown in FIG. 2, the two long bolts 7*a* and 7*b* of the four long bolts 7*a*, 7*b*, 7*c*, and 7*d* are relatively longer than the remaining long bolts 7*c* and 7*d* so that they pass through the bottom cover 12 adapted to cover the bottom of the hydrogen-oxygen mixture gas generation water tank 10 and enter the installation space 12*a* in which the power supply and control part 5 is mounted (See FIG. 2), and contrarily, the remaining long bolts 7*c* and 7*d* with relatively shorter lengths than the two long bolts 7*a* and 7*b* are supportedly inserted into concave grooves (not shown) formed to a given depth on top of the bottom cover 12 (See FIGS. 11 and 12).

Figure 5:
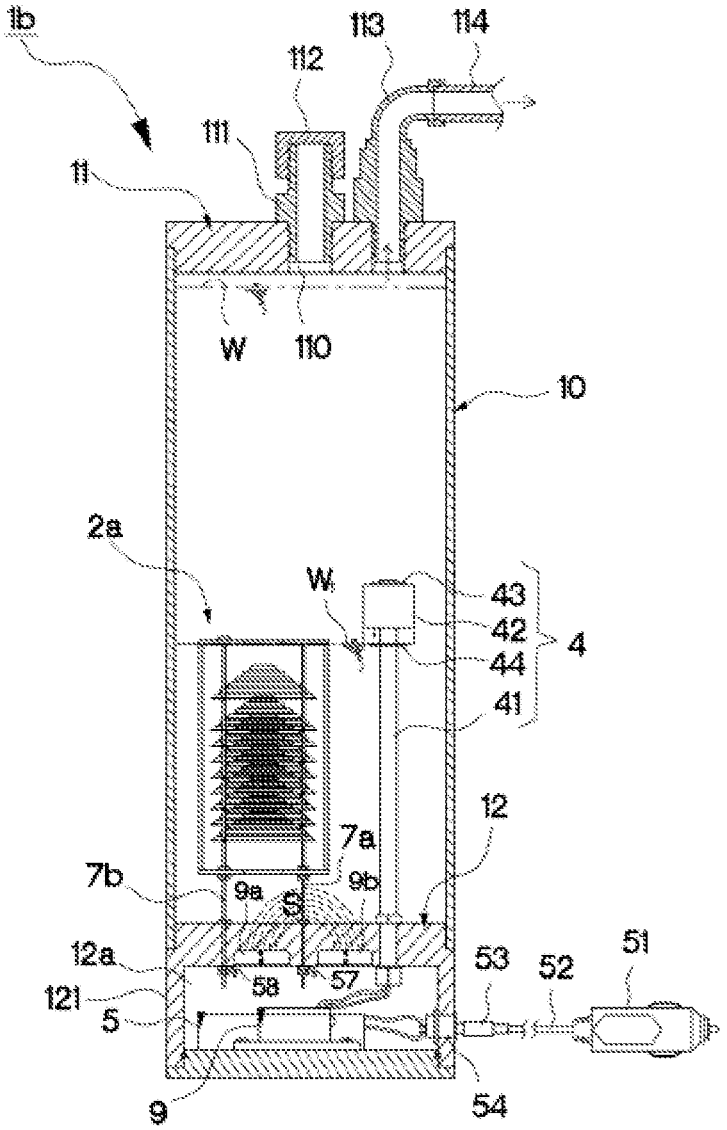
FIG. 5 is a sectional view showing the hydrogen-oxygen mixture gas producing and supplying device according to the second embodiment of the present invention.
Figure 9:
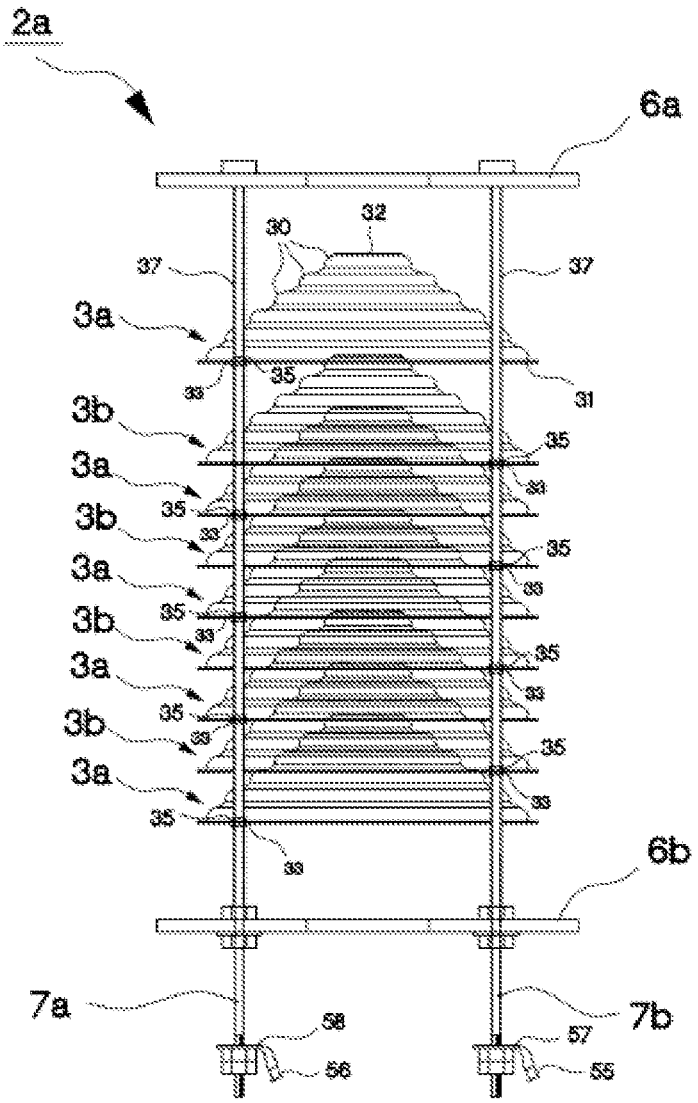
FIG. 9 is a sectional view showing the plurality of positive and negative electrode plates laminated on top of one another to the shape of "/\" in the hydrogen-oxygen mixture gas producer according to the present invention.

Further, as shown in FIGS. 3 and 5, the two long bolts 7*a* and 7*b* passing through the bottom cover 12 have positive and negative connection terminals 57 and 58 coupled to the lower end peripheries thereof and connected to positive and negative wires 55 and 56 drawn from the power supply and control part 5. As shown in FIG. 9, the positive connection terminal 57 to which the positive wire 55 is connected is coupled to a screw portion formed on the lower end periphery of the long bolt 7*b*, and the negative connection terminal 58 to which the negative wire 56 is connected is coupled to a screw portion formed on the lower end periphery of the long bolt 7*a*.

Figure 6:
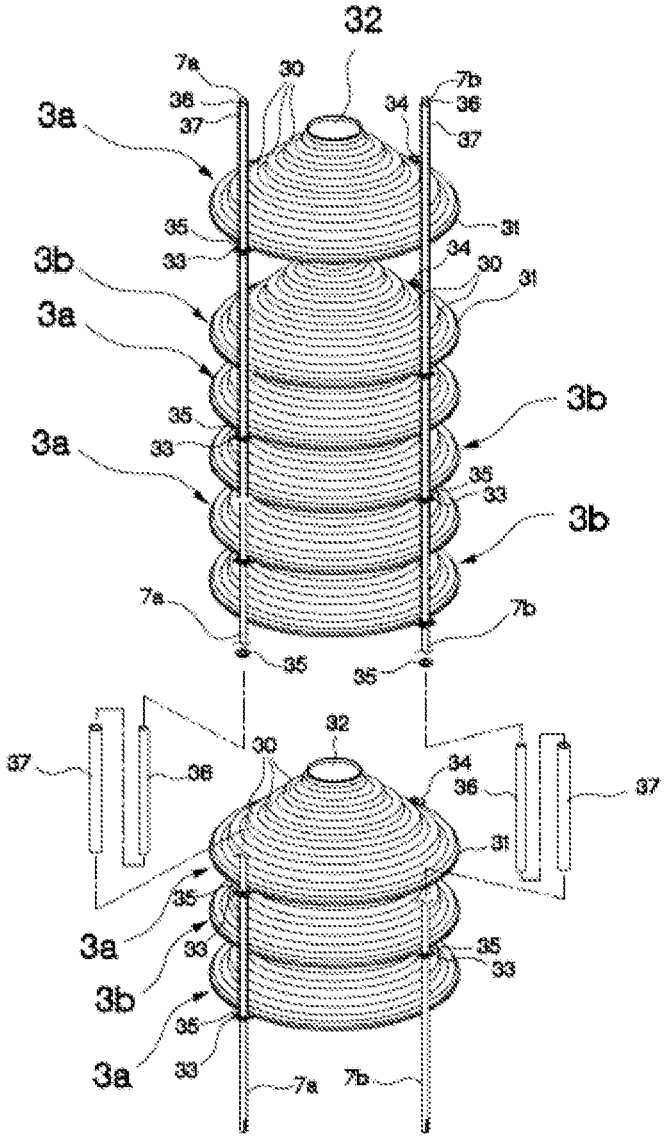
FIG. 6 is a perspective view showing a plurality of positive and negative electrode plates laminated on top of one another in the hydrogen-oxygen mixture gas producer according to the present invention.
Figure 10:
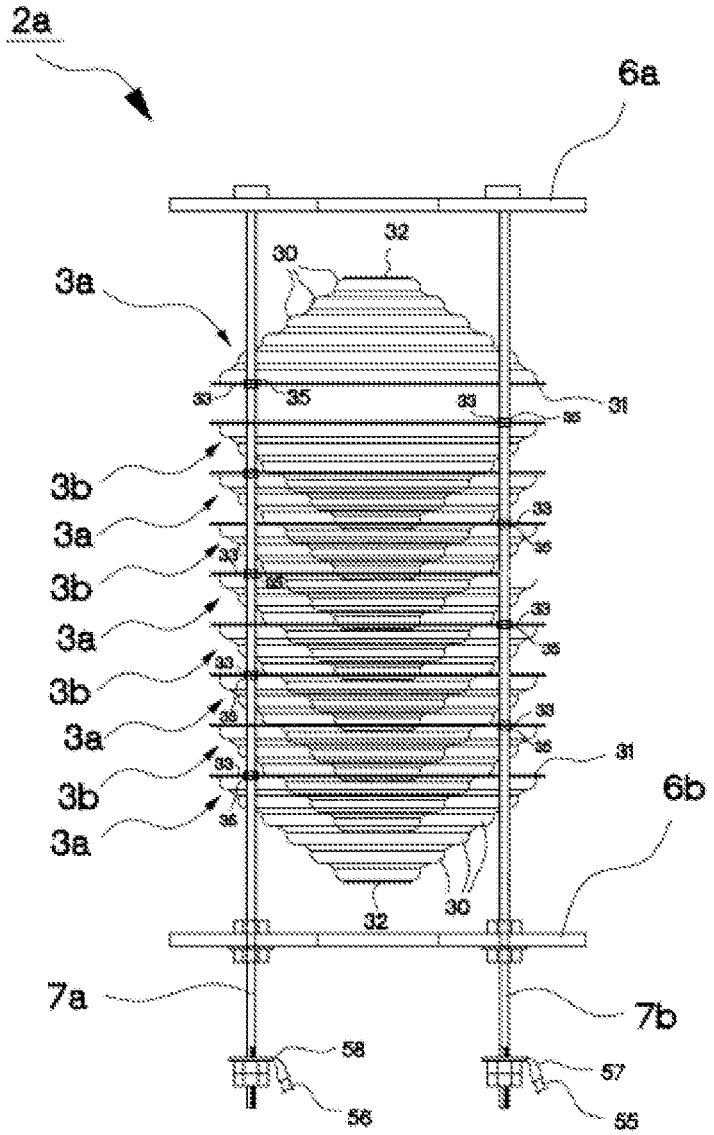
FIG. 10 is a sectional view showing the plurality of positive and negative electrode plates laminated on top of one another to the shape of "\/" in the hydrogen-oxygen mixture gas producer according to the present invention.

Each hydrogen-oxygen mixture gas producer 2*a* is configured to have the plurality of positive electrode plates 3*a* and the plurality of negative electrode plates 3*b* alternately laminated on top of one another, while having the given distance vertically in up and down directions. As shown in FIGS. 6 and 9, they are laminated on top of one another, while each having the sectional area of the shape of "/\" in which it becomes narrow toward the top and wide toward the bottom, and otherwise, as shown in FIG. 10, they are laminated on top of one another, while each having the sectional area of the shape of "\/" in which it becomes wide toward the top and narrow toward the bottom.

Further, as shown in FIG. 6, the plurality of fixing flanges 33 and 34 disposed symmetrically on each electrode plate are tightly contactedly coupled to metal washers 35, and metal conductive pipes 36 surroundingly come into contact with the outer peripheries of the long bolts 7*a*, 7*b*, 7*c*, and 7*d* passing through the fixing flanges 33 and 34. Further, insulation pipes 37 surroundingly come into contact with the outer peripheries of the metal conductive pipes 36. As a result, the positive current and the negative current supplied to the long bolts 7*a* and 7*b* flow well to the positive electrode plates 3*a* and the negative electrode plates 3*b*, and further, the long bolts 7*a* and 7*b* are desirably not exposed to the water stored in the hydrogen-oxygen mixture gas generation water tank 10 (See FIG. 6).

Figure 7A:
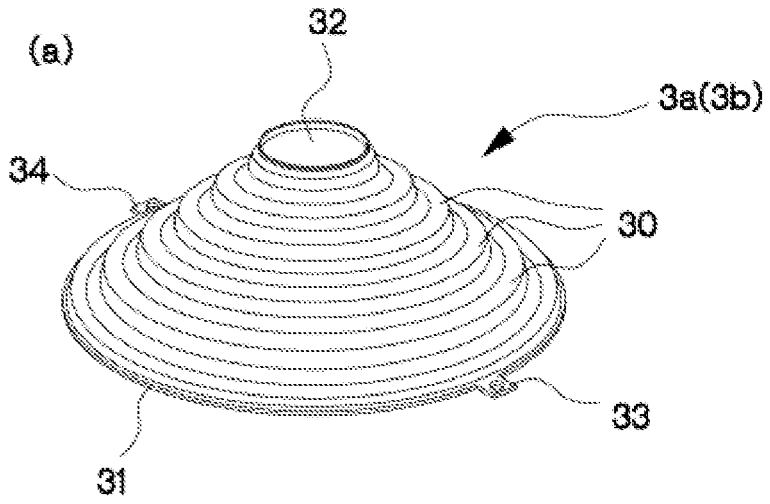
FIGS. 7A and 7B are perspective and sectional views showing an example of each positive or negative electrode plate according to the present invention.
Figure 7B:
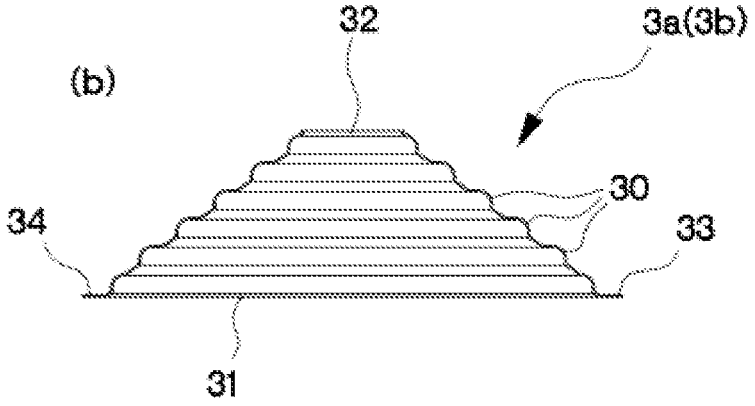
Figure 8A:
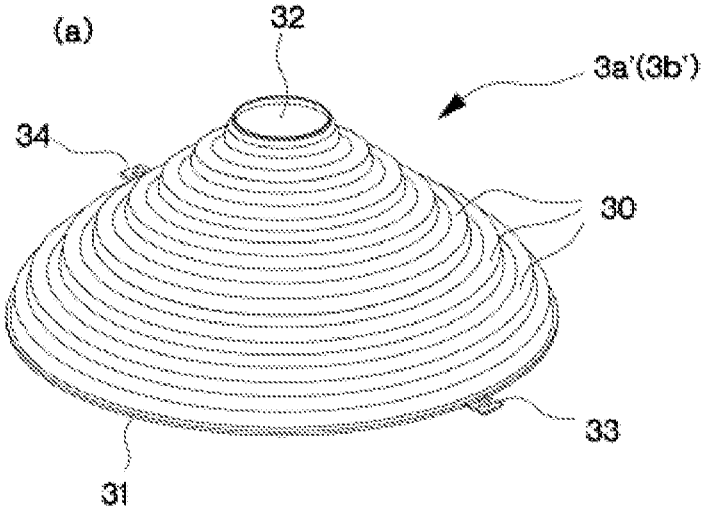
FIGS. 8A and 8B are perspective and sectional views showing another example of each positive or negative electrode plate according to the present invention.
Figure 8B:
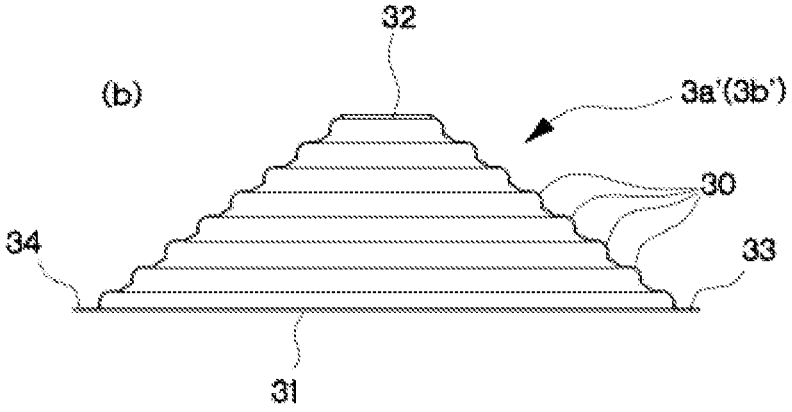

Each hydrogen-oxygen mixture gas producer 2*a* is configured to allow the plurality of positive electrode plates 3*a* and the plurality of negative electrode plates 3*b* to have a conical sectional area of the shape of "/\" in which each electrode plate becomes narrow toward the top and wide toward the bottom, as shown in FIGS. 7A and 7B, or to have a reversely conical sectional area of the shape of "\/" in which each electrode plate becomes wide toward the top and narrow toward the bottom, as shown in FIGS. 8A and 8B. However, even though not shown in the drawings, the plurality of positive electrode plates 3*a* and the plurality of negative electrode plates 3*b* may have the shape of a polygonal pyramid such as a hexagonal pyramid, an octagonal pyramid, and the like.

The distances between the positive electrode plates 3*a* and the negative electrode plates 3*b* may not be made equally. If the distances are small, a large amount of the electric current is consumed, so that an amount of the hydrogen-oxygen mixture gas produced is increased, but the life spans of the electrode plates are shortened. Contrarily, if the distances are long, a small amount of the electric current is consumed, so that an amount of the hydrogen-oxygen mixture gas produced is decreased, but the life spans of the electrode plates are increased. Accordingly, the distances are appropriately controlled in consideration of the above-mentioned results.

Figure 11:
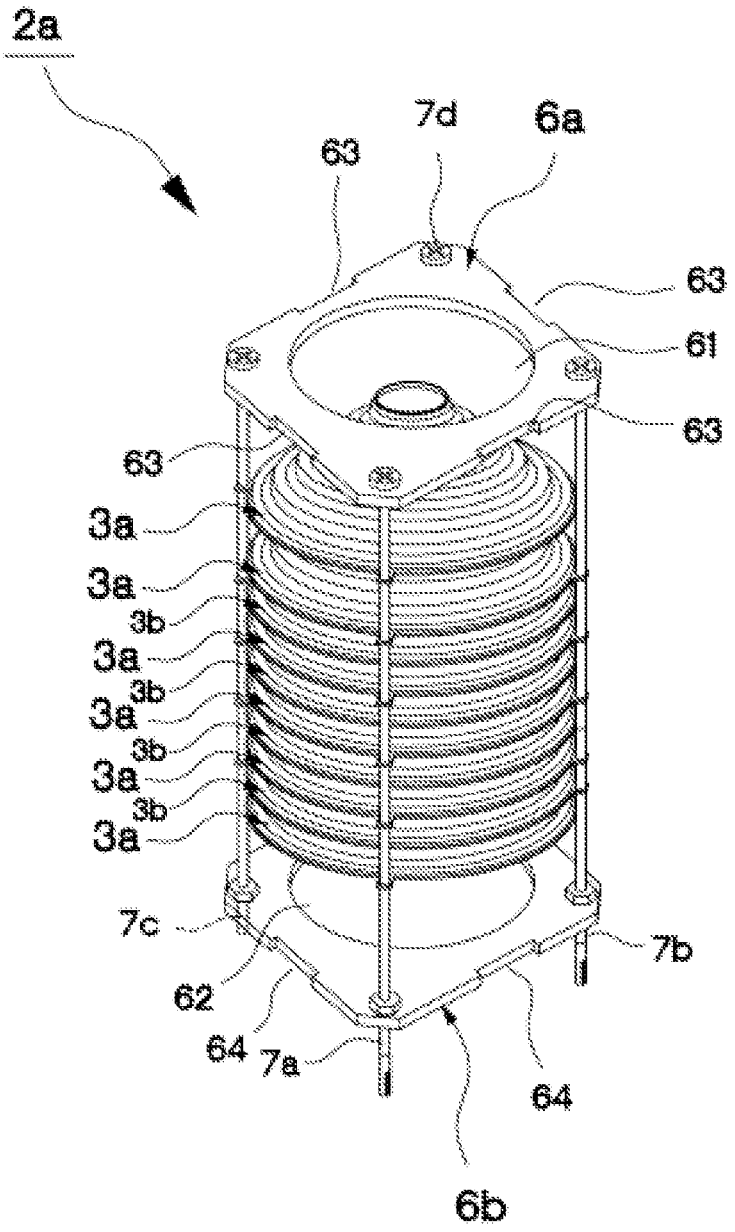
FIG. 11 is a perspective view showing the coupled state of the plurality of positive and negative electrode plates in the hydrogen-oxygen mixture gas producer according to the present invention.
Figure 12:
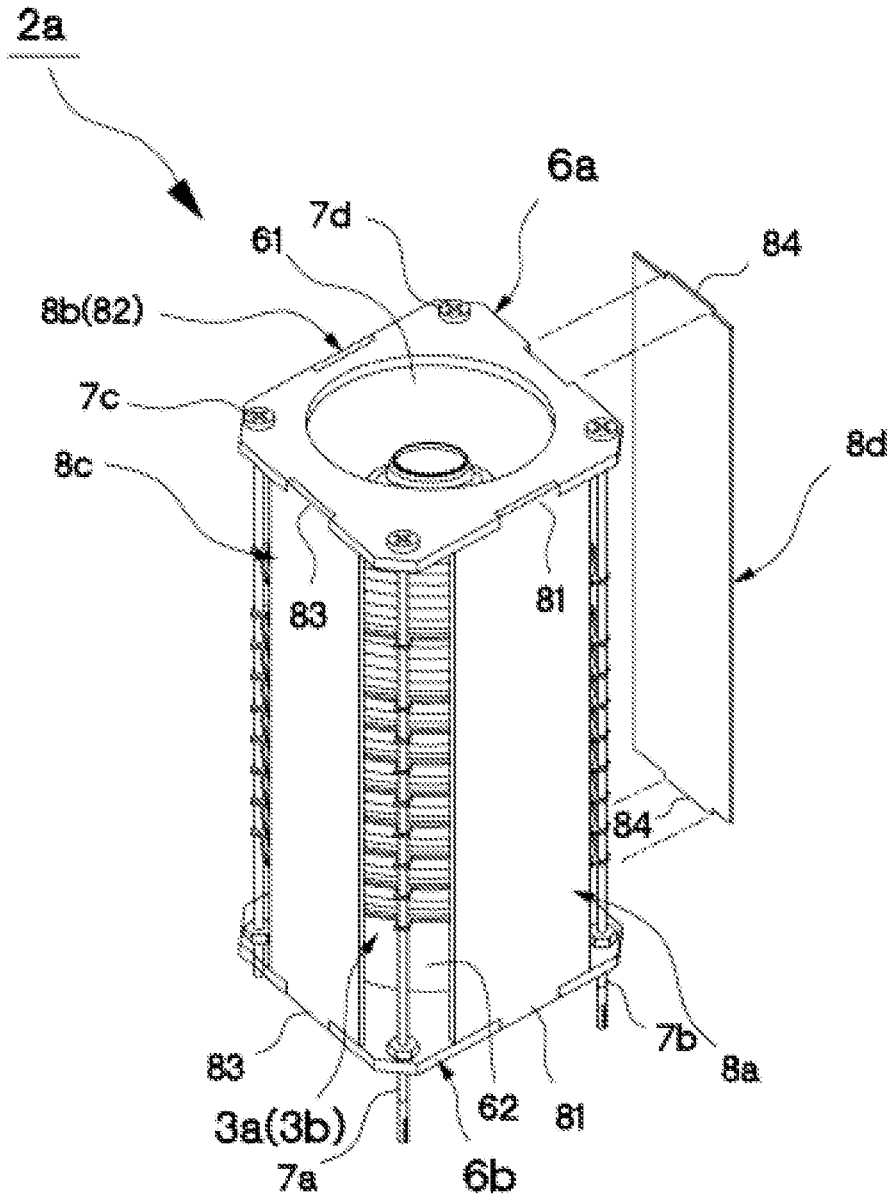
FIG. 12 is a perspective view showing a plurality of cover plates for hiding the positive and negative electrode plates laminated on top of one another in the hydrogen-oxygen mixture gas producer according to the present invention.

As shown in FIGS. 11 and 12, each hydrogen-oxygen mixture gas producer 2*a* has relatively large holes 61 and 62 formed on centers of the top and bottom support plates 6*a* and 6*b* and a plurality of cover plates 8*a*, 8*b*, 8*c*, and 8*d* mounted on the four sides of the top and bottom support plates 6*a* and 6*b* to provide side wall surfaces thereof. Further, the cover plates 8*a*, 8*b*, 8*c*, and 8*d* have coupling protrusions 81, 82, 83, and 84 protruding from tops and undersides thereof, and the top and bottom support plates 6*a* and 6*b* have top and underside coupling grooves 63 and 64 adapted to forcedly fit the coupling protrusions 81, 82, 83, and 84 thereto.

Figure 16:
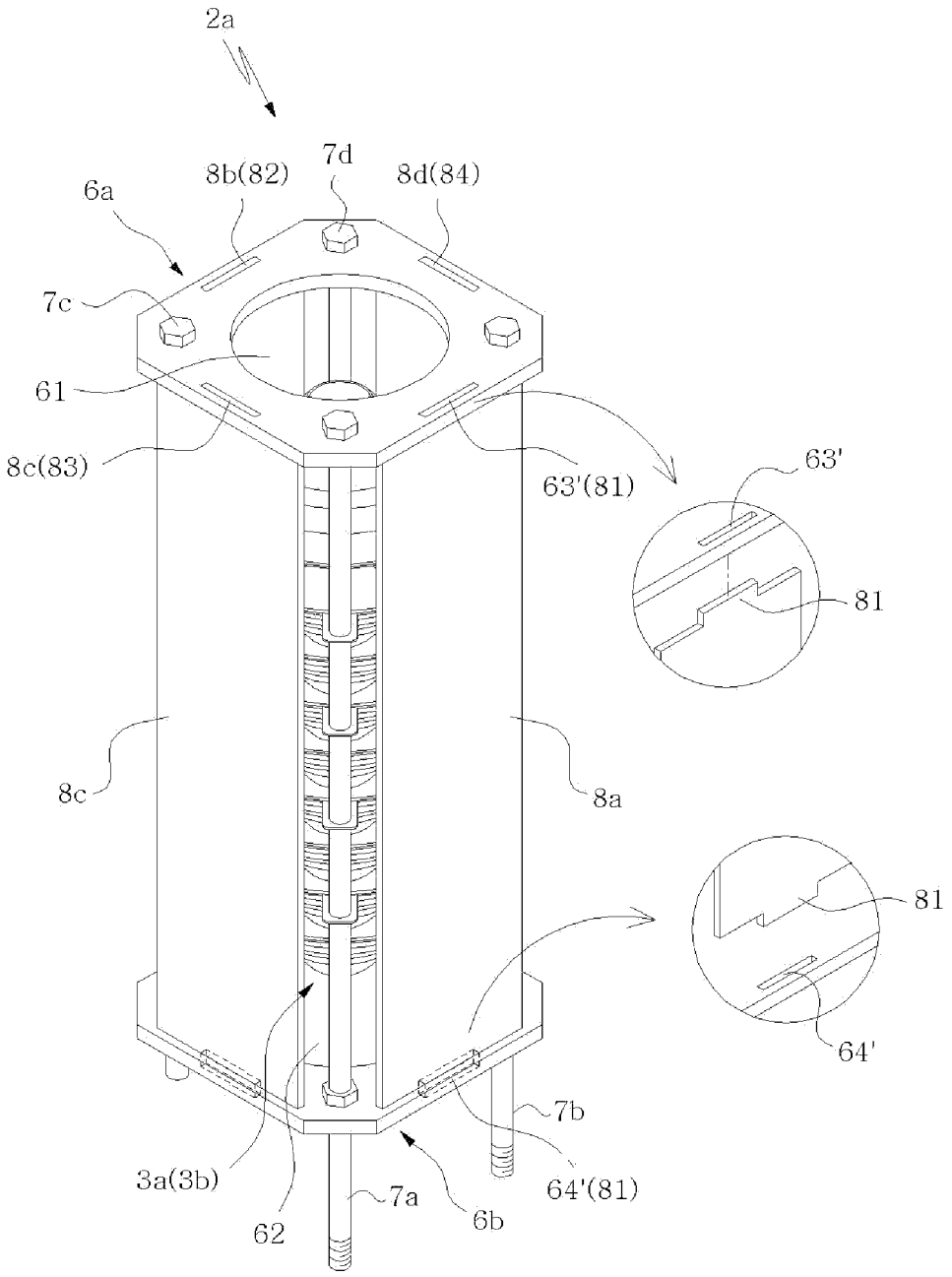
FIG. 16 is another perspective view showing a plurality of cover plates for hiding the positive and negative electrode plates laminated on top of one another in the hydrogen-oxygen mixture gas producer according to the present invention.

Meanwhile, as shown in FIG. 16, it is possible for the top and bottom support plates 6*a* and 6*b* to have top and underside coupling holes 63' and 64' adapted to forcedly fit the coupling protrusions 81, 82, 83, and 84 thereto.

The cover plates 8*a*, 8*b*, 8*c*, and 8*d* are adapted to hide the plurality of positive and negative electrode plates 3*a* and 3*b* laminated on top of one another while having the given distances from one another vertically from the outside, and further, they provide advertising printing surfaces (having no reference numerals) thereon to represent all kinds of explanation or advertising words, so that an explanation of the hydrogen-oxygen mixture gas production capability of the hydrogen-oxygen mixture gas producers 2*a* as well as the installation method of the hydrogen-oxygen mixture gas producing and supplying device 1*a* may be provided to help the hydrogen-oxygen mixture gas producing and supplying device 1*a* safely installed and used by a user. However, the cover plates 8*a*, 8*b*, 8*c*, and 8*d* do not hide the plurality of positive and negative electrode plates 3*a* and 3*b* entirely, and desirably, they expose a portion of the internal configuration of each hydrogen-oxygen mixture gas producer 2*a*, while hiding the hydrogen-oxygen mixture gas producer 2*a* mostly, so that desirably, the hydrogen-oxygen mixture gas generated to the form of air bubbles from the inside of the hydrogen-oxygen mixture gas producer 2*a* can be checked with the naked eye.

According to the present invention, further, the hydrogen-oxygen mixture gas producing and supplying device 1*a* has the water level sensor part 4 for sensing storage levels W and $W_1$ of the water stored in the hydrogen-oxygen mixture gas generation water tank 10. The water level sensor part 4 includes a fixing post 41 fixedly located vertically on the bottom cover 12 and a float 42 disposed on the fixing post 41 to move up and down while floating on the water. If water is full in the hydrogen-oxygen mixture gas generation water tank 10, the float 42 moves up to operate a top sensor 43, and if water is at the storage level $W_1$ lower than the top support plate 6*a* owing to shortage, the float 42 moves down to operate a bottom sensor 44. The top and bottom sensors 43 and 44 are fixed to the fixing post 41, while having a given distance from each other in up and down directions, so as to sense the position of the float 42.

Further, the power supply and control part 5, which is mounted in the installation space 12*a* formed inside the bottom cover 12 coupled to the bottom of the hydrogen-oxygen mixture gas generation water tank 10, is configured to sense whether the float 42 of the water level control sensor part 4 is detected by the top sensor 43 or the bottom sensor 44. When the storage level W 1 of the water stored in the hydrogen-oxygen mixture gas generation water tank 10 is lower than the uppermost negative electrode plate 3*b* under the top support plate 6*a* of each hydrogen-oxygen mixture gas producer 2*a* to cause the float 42 to move down and be connected to the bottom sensor 44, further, a warning part 9, which is mounted in the installation space 12*a*, generates a warning sound and simultaneously operates an LED blinking lamp 91, thereby notifying the user of the lack of water of the hydrogen-oxygen mixture gas generation water tank 10. Contrarily, when the storage level W of the water stored in the hydrogen-oxygen mixture gas generation water tank 10 is higher than the hydrogen-oxygen mixture gas producer 2*a* to cause the float 42 to move up and be connected to the top sensor 43, the warning sound is not generated from the warning part 9 and the LED blinking lamp 91 does not operate.

Each hydrogen-oxygen mixture gas producer 2*a* is configured to allow the positive and negative electrode plates 3*a* and 3*b* alternately laminated on top of one another between the top and bottom support plates 6*a* and 6*b*, and in this case, desirably, the negative electrode plate 3*b* is placed on the lowermost position, and further, the negative electrode plate 3*b* is placed on the uppermost position, so that the positive and negative electrode plates 3*a* and 3*b* perform the electrolysis actively, reduce the amount of power (DC or AC) used, and improve the production efficiency of the hydrogen-oxygen mixture gas through the electrolysis.

According to the first embodiment of the present invention, desirably, the hydrogen-oxygen mixture gas producing and supplying device 1*a* further includes a plurality of permanent magnets 9*a* and 9*b* built in the underside of the bottom cover 12 adapted to seal the bottom of the hydrogen-oxygen mixture gas generation water tank 10, so that the magnetic fields S generated from the plurality of permanent magnets 9*a* and 9*b* serve to actively move the water molecules stored in the hydrogen-oxygen mixture gas generation water tank 10, thereby improving the production efficiency of the hydrogen-oxygen mixture gas of the hydrogen-oxygen mixture gas producer 2*a* and preventing the water stored in the hydrogen-oxygen mixture gas generation water tank 10 from icing in winter seasons.

As described above, the hydrogen-oxygen mixture gas producing and supplying device 1*a* according to the first embodiment of the present invention is provided with the plurality of hydrogen-oxygen mixture gas producers 2*a* inside the hydrogen-oxygen mixture gas generation water tank 10 and the electric current control part disposed on the power supply and control part 5 to control amounts of hydrogen and oxygen produced per unit time.

Figure 4:
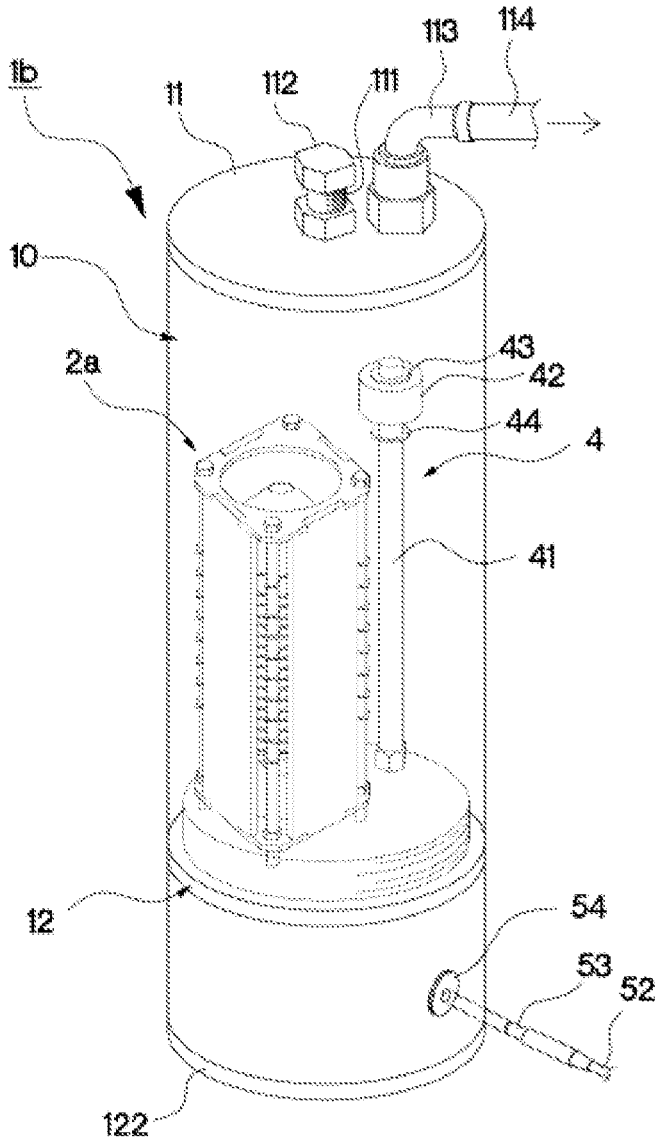
FIG. 4 is a perspective view showing a hydrogen-oxygen mixture gas producing and supplying device according to a second embodiment of the present invention.
Figure 13:
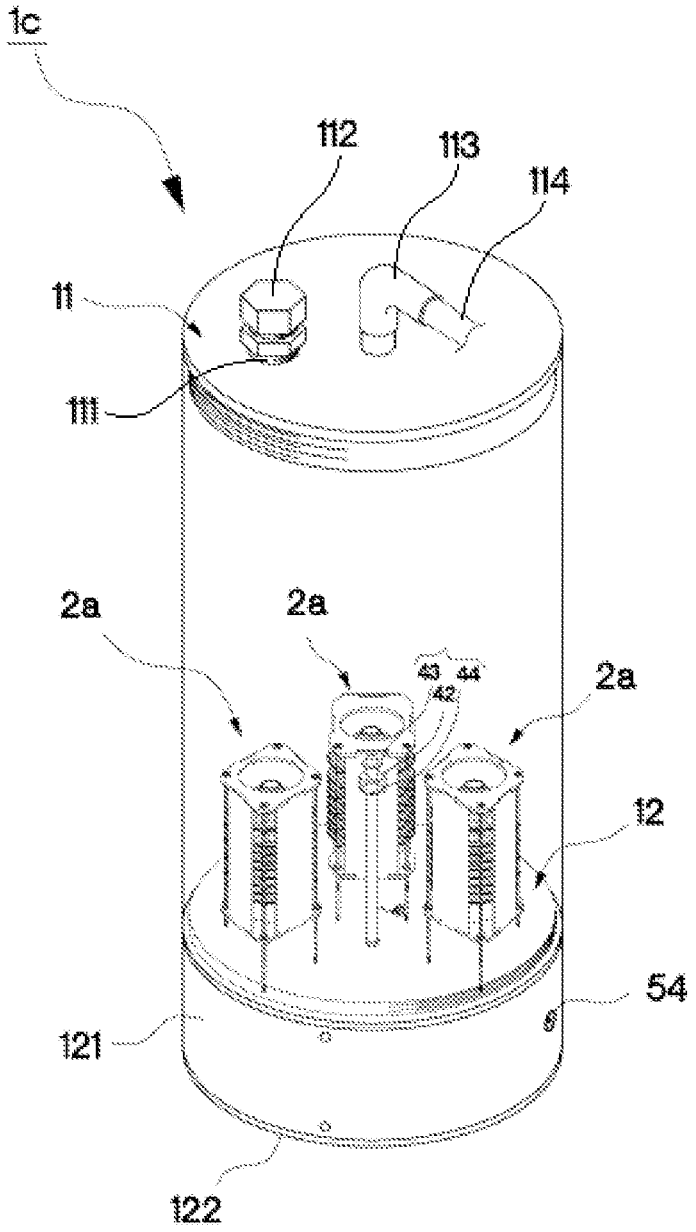
FIG. 13 is a perspective view showing a hydrogen-oxygen mixture gas producing and supplying device having three hydrogen-oxygen mixture gas producers according to a third embodiment of the present invention.

Further, the hydrogen-oxygen mixture gas producing and supplying device 1*a* according to the first embodiment of the present invention is provided with the plurality of hydrogen-oxygen mixture gas producers 2*a* inside the hydrogen-oxygen mixture gas generation water tank 10, which has a larger amount of hydrogen-oxygen mixture gas, when compared with a second embodiment of the present invention (See FIGS. 4 and 5) in which one hydrogen-oxygen mixture gas producer 2*a* is disposed inside the hydrogen-oxygen mixture gas generation water tank 10. The hydrogen-oxygen mixture gas producing and supplying device 1*b* according to the second embodiment of the present invention, as shown in FIGS. 4 and 5, is configured to have one hydrogen-oxygen mixture gas producer 2*a* disposed inside the hydrogen-oxygen mixture gas generation water tank 10, and a hydrogen-oxygen mixture gas producing and supplying device 1*c* according to a third embodiment of the present invention, as shown in FIG. 13, is configured to have three hydrogen-oxygen mixture gas producers 2*a* disposed inside the hydrogen-oxygen mixture gas generation water tank 10. Accordingly, the hydrogen-oxygen mixture gas produced from each device is supplied to the intake manifold adapted to supply fuel and air to an automobile engine so that the complete combustion of the fuel is accelerated to improve engine performance and prevent smoke from occurring.

Using the hydrogen-oxygen mixture gas producing and supplying device 1*b* as shown in FIG. 4 that is configured to have one hydrogen-oxygen mixture gas producer 2*a* disposed inside the hydrogen-oxygen mixture gas generation water tank 10 or using the hydrogen-oxygen mixture gas producing and supplying device 1*c* as shown in FIG. 13 that is configured to have the three hydrogen-oxygen mixture gas producers 2*a* disposed inside the hydrogen-oxygen mixture gas generation water tank 10, the water stored in the hydrogen-oxygen mixture gas generation water tank 10 is electrolyzed to produce hydrogen and oxygen. In specific, using the hydrogen-oxygen mixture gas producing and supplying device 1*a* as shown in FIG. 1 that is configured to have the two hydrogen-oxygen mixture gas producers 2*a* disposed inside the hydrogen-oxygen mixture gas generation water tank 10, the hydrogen-oxygen mixture gas producing and supplying device 1*b* as shown in FIG. 4 that is configured to have one hydrogen-oxygen mixture gas producer 2*a* disposed inside the hydrogen-oxygen mixture gas generation water tank 10, or the hydrogen-oxygen mixture gas producing and supplying device 1*c* as shown in FIG. 13 that is configured to have the three hydrogen-oxygen mixture gas producers 2*a* disposed inside the hydrogen-oxygen mixture gas generation water tank 10, the water stored in the hydrogen-oxygen mixture gas generation water tank 10 is electrolyzed to produce hydrogen and oxygen. In the same manner as above, a hydrogen-oxygen mixture gas producing and supplying device 1*d* as shown in FIG. 15 that is configured to have two hydrogen-oxygen mixture gas producer 2*a* disposed inside the hydrogen-oxygen mixture gas generation water tank 10, the water stored in the hydrogen-oxygen mixture gas generation water tank 10 is electrolyzed to produce hydrogen and oxygen. All of the hydrogen-oxygen mixture gas producing and supplying devices 1*a* to 1*d* may have the external display panel 59 mounted on the lower portion thereof and having the rotating volume knob 59*a* mounted on the external display panel 59 to adjust the electric current of the power received from the outside appropriately, so that an appropriate amount of hydrogen-oxygen mixture gas corresponding to the load or displacement of the automobile is controlled and supplied.

According to the second embodiment of the present invention, the hydrogen-oxygen mixture gas producing and supplying device 1*b* includes the hydrogen-oxygen mixture gas generation water tank 10, the hydrogen-oxygen mixture gas producer 2*a* fixed to the inside of the hydrogen-oxygen mixture gas generation water tank 10, and a water level sensor part 4 fixedly disposed vertically on the bottom cover 12, while being close to the hydrogen-oxygen mixture gas producer 2*a*, to detect the storage level of the water stored in the hydrogen-oxygen mixture gas generation water tank 10 and notify a user of water refill time.

Further, the hydrogen-oxygen mixture gas producing and supplying device 1*b* according to the second embodiment of the present invention includes a water inlet pipe 111 screw-coupled to a top cover 11 mounted openably and closably on top of the hydrogen-oxygen mixture gas generation water tank 10 to supply water to the hydrogen-oxygen mixture gas generation water tank 10 and a hydrogen-oxygen mixture gas outlet pipe 113 protruding outward from the top cover 11 to exhaust the hydrogen-oxygen mixture gas produced by the water electrolysis operation of the hydrogen-oxygen mixture gas producer 2*a*. The hydrogen-oxygen mixture gas outlet pipe 113 is connected to a hydrogen-oxygen mixture gas supply hose 114 adapted to supply the hydrogen-oxygen mixture gas to an intake manifold (not shown) connected to each combustion chamber of an automobile engine or a combustion chamber (not shown) of a fuel ignition burner. Here, the hydrogen-oxygen mixture gas outlet pipe 113 is located outside (See FIG. 1) or in the center (See FIG. 13) of the top cover 11.

Further, the hydrogen-oxygen mixture gas producing and supplying device 1*b* according to the second embodiment of the present invention includes a bottom cover 12 screw-coupled to the bottom of the hydrogen-oxygen mixture gas generation water tank 10 to open and close the bottom of the hydrogen-oxygen mixture gas generation water tank 10, an extension cylinder 121 extending from the outer periphery of the bottom cover 12, and a bottom sealing plate 122 for sealing the bottom of the extension cylinder 121 to form an installation space 12*a* in which a power supply and control part 5 is mounted to supply and control the power to the hydrogen-oxygen mixture gas producer 2*a*.

As shown in FIG. 5, the power supply and control part 5 includes a power connection terminal 54 fixed exposedly to one side of the extension cylinder 121, a power plug 51 adapted to receive power from the outside, a connection wire 52 connected to the power plug 51, and a connection socket 53 disposed on end of the connection wire 52, so that the connection socket 53 is connected to the power connection terminal 54 to supply the power supplied from the outside to the power supply and control part 5. Further, the power supply and control part 5 is configured to the form of a printed circuit board (having no reference numeral) on which all kinds of electronic parts (having no reference numerals) are mounted to supply the power supplied from the outside to the plurality of positive and negative electrode plates 3*a* and 3*b* alternately laminated on top of one another in the hydrogen-oxygen mixture gas producer 2*a*, so that the power supply and control part 5 allows the plurality of positive and negative electrode plates 3*a* and 3*b* to perform the electrolysis and normally operates the water level sensor part 4 and a warning part 9.

Further, the hydrogen-oxygen mixture gas producer 2*a* of the hydrogen-oxygen mixture gas producing and supplying device 1*b* includes the plurality of positive and negative electrode plates 3*a* and 3*b* alternately laminatedly coupled vertically on top of one another by means of four long bolts 7*a*, 7*b*, 7*c*, and 7*d*. In this case, the lower end peripheries of the two long bolts 7*a* and 7*b* are coupled to positive and negative connection terminals 57 and 58 connected to positive and negative wires 55 and 56 drawn from the power supply and control part 5, so that the positive and negative currents are applied to the plurality of positive and negative electrode plates 3*a* and 3*b* (See FIGS. 5 and 6). The water level sensor part 4 of the hydrogen-oxygen mixture gas producing and supplying device 1*b* serves to detect the storage level of the water stored in the hydrogen-oxygen mixture gas generation water tank 10, and if an appropriate amount of water is not stored in the hydrogen-oxygen mixture gas generation water tank 10, the warning part 9 generates a warning sound or operates an LED blinking lamp 91, which is the same as in the first embodiment of the present invention. Therefore, a detailed explanation of the water level sensor part 4 and the warning part 9 will be avoided.

According to the second embodiment of the present invention, desirably, the hydrogen-oxygen mixture gas producing and supplying device 1*b* further includes a plurality of permanent magnets 9*a* and 9*b* built in the underside of the bottom cover 12 screw-coupled to the bottom of the hydrogen-oxygen mixture gas generation water tank 10 to prevent the water stored in the hydrogen-oxygen mixture gas generation water tank 10 from icing in winter seasons using magnetic fields S generated from the permanent magnets 9*a* and 9*b*. Further, the plurality of permanent magnets 9*a* and 9*b* serve to actively move the water molecules, thereby improving the production efficiency of the hydrogen-oxygen mixture gas of the hydrogen-oxygen mixture gas producer 2*a*.

As shown in FIGS. 13 and 15, a hydrogen-oxygen mixture gas producing and supplying device 1*c* or 1*d* according to a third or fourth embodiment of the present invention is configured to have three or two hydrogen-oxygen mixture gas producers 2*a* disposed spaced apart from one another by a given distance inside a hydrogen-oxygen mixture gas generation water tank 10, thereby producing and supplying a larger amount of hydrogen-oxygen mixture gas than the hydrogen-oxygen mixture gas produced in the first embodiment (See FIG. 1) and the second embodiment (See FIG. 4) of the present invention.

According to the third embodiment of the present invention, the hydrogen-oxygen mixture gas producing and supplying device 1*c* is configured to have three hydrogen-oxygen mixture gas producers 2*a* disposed spaced apart from one another by a given distance inside one hydrogen-oxygen mixture gas generation water tank 10 and to have a warning part 9 for generating a warning sound and operating an LED blinking lamp 91 if the storage level of the stored in the hydrogen-oxygen mixture gas generation water tank 10 is lower than tops of the three hydrogen-oxygen mixture gas producers 2*a*. In this case, each hydrogen-oxygen mixture gas producer 2*a* includes a plurality of positive and negative electrode plates 3*a* and 3*b* alternately laminatedly coupled vertically on top of one another, so that the positive current of the power supplied from the outside is applied to the positive electrode plates 3*a* and the negative current is applied to the negative electrode plates 3*b*, thereby allowing the plurality of positive and negative electrode plates 3*a* and 3*b* to perform electrolysis. Such a configuration is the same as those in the first and second embodiments, and therefore, a detailed explanation of the configuration will be avoided.

According to the third embodiment of the present invention, the hydrogen-oxygen mixture gas producing and supplying device 1*c* includes a water inlet pipe 111 screw-coupled to a top cover 11 to supply water to the hydrogen-oxygen mixture gas generation water tank 10, a hydrogen-oxygen mixture gas outlet pipe 113 protruding outward from the top cover 11 to exhaust the hydrogen-oxygen mixture gas produced by each hydrogen-oxygen mixture gas producer 2*a*, a hydrogen-oxygen mixture gas supply hose 114 connected to the hydrogen-oxygen mixture gas outlet pipe 113 to supply the hydrogen-oxygen mixture gas to an intake manifold (not shown) connected to an automobile engine or a combustion chamber (not shown) of a fuel ignition burner.

So as to produce a larger amount of hydrogen-oxygen mixture gas using the three hydrogen-oxygen mixture gas producers 2*a*, further, the hydrogen-oxygen mixture gas producing and supplying device 1*c* according to the third embodiment of the present invention is configured to allow each positive electrode plate 3*a* and each negative electrode plate 3*b* to have a larger number of round bent portions 30 than those in the first and second embodiments of the present invention, thereby providing more enlarged electrolysis areas. The positive and negative electrode plates 3*a*' and 3*b*' as shown in FIGS. 8A and 8B are alternately laminated vertically on top of one another. That is, the positive and negative electrode plates 3*a* and 3*b* of each hydrogen-oxygen mixture gas producer 2*a* as shown in FIG. 1 and the positive and negative electrode plates 3*a* and 3*b* of the hydrogen-oxygen mixture gas producer 2*a* as shown in FIG. 4 have six round bent portions formed concentrically, as shown in FIGS. 7A and 7B, but the positive and negative electrode plates 3*a* and 3*b* of each hydrogen-oxygen mixture gas producer 2*a* as shown in FIG. 13 have eight round bent portions formed concentrically, as shown in FIGS. 8A and 8B.

According to the third embodiment of the present invention, desirably, the hydrogen-oxygen mixture gas producing and supplying device 1*c* further includes a plurality of permanent magnets 9*a* and 9*b* built in the underside of the bottom cover 12 screw-coupled to the bottom of the hydrogen-oxygen mixture gas generation water tank 10, thereby preventing the water stored in the hydrogen-oxygen mixture gas generation water tank 10 from icing in winter seasons using magnetic fields S generated from the plurality of permanent magnets 9*a* and 9*b* and actively moving the water molecules to improve the production efficiency of the hydrogen-oxygen mixture gas.

Figure 14A:
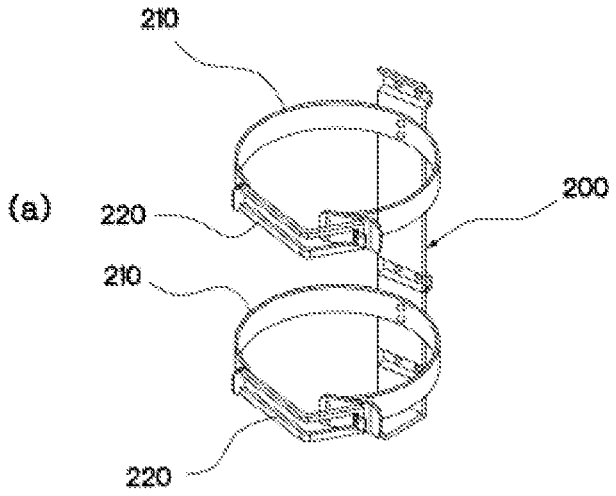
FIGS. 14A and 14B are perspective and side views showing a fixing support rod for fixing the hydrogen-oxygen mixture gas producing and supplying device of the present invention and an installed state of the hydrogen-oxygen mixture gas producing and supplying device of the present invention.
Figure 14B:
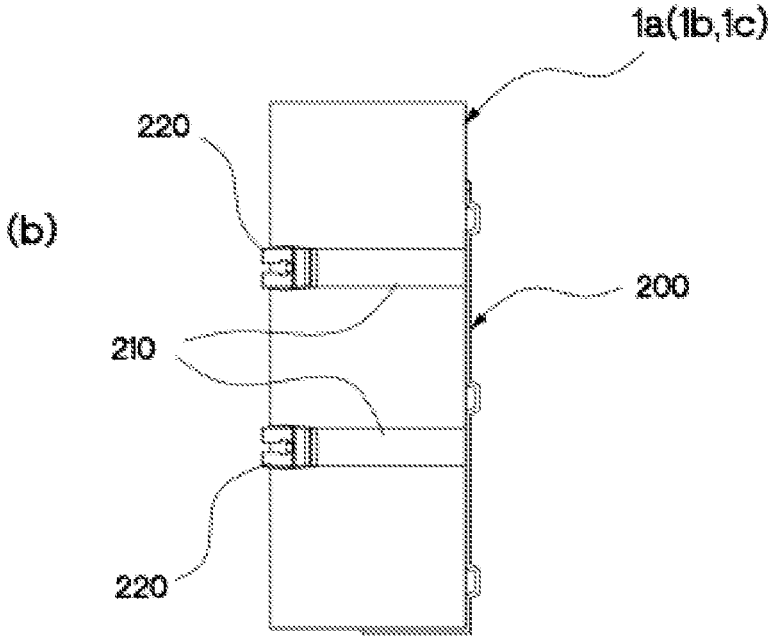

Further, the hydrogen-oxygen mixture gas producing and supplying devices 1*a*, 1*b*, and 1*c* according to the first to third embodiments of the present invention may be coupled to a driver seat or passenger seat using fixing bands 210 and fastening bands 220 of a fixing support 200 (See FIGS. 14A and 14B), and otherwise, they may be coupledly disposed at a boiler room in which the fuel ignition burner is located.

The hydrogen-oxygen mixture gas producing and supplying devices 1*a*, 1*b*, and 1*c* as shown in FIGS. 1, 4 and 13 according to the first to third embodiments of the present invention may be applied to all kinds of automobiles having an internal combustion engine using gasoline, diesel, LPG, hybrid fuel, and the like and also to a combustion room of the fuel ignition burner, so that they are appropriately selected to produce and supply an amount of hydrogen-oxygen mixture gas required according to the power and exhaust capacity of the automobile engine.

Accordingly, the hydrogen-oxygen mixture gas producing and supplying devices 1*a*, 1*b*, and 1*c* according to the first to third embodiments of the present invention may be applied to all kinds of automobiles according to the exhaust capacities of engines.

For example, in the case of a car, the hydrogen-oxygen mixture gas producing and supplying devices 1*a*, 1*b*, and 1*c* are selected according to the exhaust capacity of the engine of the car, and in the case of a truck, they are selected according to the amount of freight loaded on the truck.

Further, the water stored in the hydrogen-oxygen mixture gas generation water tanks 10 of the hydrogen-oxygen mixture gas producing and supplying devices 1*a*, 1*b*, and 1*c* is desirably purified water, and water used in many countries of the world may have a little different ingredients. In Korea, tap water may be available, but so as to minimize the occurrence of scales on the surface of the metal member, desirably, the water stored in the hydrogen-oxygen mixture gas generation water tank 10 is bottled water or pure water, particularly, bottled water having a relatively small amount of iron (for example, product name, 'Baeksansoo', 'Samdasoo', and the like). If it is desired to use distilled water, an extreme amount of boron is added to the distilled water, and in this case, desirably, a mixing ratio of distilled water to boron is 10,000:1.

Each hydrogen-oxygen mixture gas producing and supplying device 1*a*, 1*b*, and 1*c* as shown in FIGS. 1, 4 and 13 is configured to have the power plug 51 of the power supply and control part 5 connected to an electrical outlet to receive power from the outside, so that the power is applied to the plurality of positive and negative electrode plates 3*a* and 3*b* and 3*a*' and 3*b*' laminated vertically on top of one another on each hydrogen-oxygen mixture gas producer 2*a*, and if the positive and negative currents are applied to the positive and negative electrode plates, the water stored in the hydrogen-oxygen mixture gas generation water tank 10 is electrolyzed by means of the positive and negative electrode plates. As a result, hydrogen and oxygen are produced in the form of fine air bubbles, and the hydrogen-oxygen mixture gas, which is produced by the electrolysis of the positive and negative electrode plates 3*a* and 3*b* and 3*a*' and 3*b*' by the positive and negative currents separately to the electrode plates, has a ratio of hydrogen and oxygen of 2:1. The hydrogen-oxygen mixture gas floats up over the surface of the water stored in the hydrogen-oxygen mixture gas generation water tank 10 and is then exhausted to the hydrogen-oxygen mixture gas outlet pipe 113. Next, the hydrogen-oxygen mixture gas is then supplied through the hydrogen-oxygen mixture gas supply hose 114 to a desired place, that is, an intake manifold (not shown) connected to an automobile engine, a combustion chamber (not shown) of a fuel ignition burner, and the like.

For example, if each hydrogen-oxygen mixture gas producing and supplying device 1*a*, 1*b*, 1*c*, or 1*d* is applied to an automobile, the hydrogen-oxygen mixture gas supply hose 114 is connected to the intake manifold (not shown) connected to the combustion chambers of an automobile engine and supplies the hydrogen-oxygen mixture gas thereto, so that the supplied hydrogen-oxygen mixture gas is mixed with air and serves as a catalyst for helping the fuel injected into the combustion chambers burnt, thereby achieving complete combustion to improve the power of the engine and reduce noise and smoke.

Each hydrogen-oxygen mixture gas producing and supplying device 1*a*, 1*b*, 1*c*, or 1*d* according to the present invention is configured to have the plurality of permanent magnets 9*a* and 9*b* built in the underside of the bottom cover 12 adapted to seal the bottom of the hydrogen-oxygen mixture gas generation water tank 10 to allow the magnetic fields S generated from the plurality of permanent magnets 9*a* and 9*b* to actively move the water molecules stored in the hydrogen-oxygen mixture gas generation water tank 10, thereby improving the production efficiency of the hydrogen-oxygen mixture gas of the hydrogen-oxygen mixture gas producer 2*a* and preventing the water stored in the hydrogen-oxygen mixture gas generation water tank 10 from icing in winter seasons.

Each hydrogen-oxygen mixture gas producing and supplying device 1*a*, 1*b*, 1*c*, or 1*d* according to the present invention is configured to allow the float 42 of the water level sensor part 4 to move up by means of buoyancy in a state where water is full in the hydrogen-oxygen mixture gas generation water tank 10 and to thus apply the buoyancy to the top sensor 43. Contrarily, if the storage level $W_1$ of the water stored in the hydrogen-oxygen mixture gas generation water tank 10 is lower than the bottom sensor 44 of the water level sensor part 4 (See FIG. 5), the float 42 pressurizes the bottom sensor 44, while being placed thereon, and in this case, the warning part 9 generates the warning sound and operates the LED blinking lamp 91, thereby notifying the user of the shortage of water. As a result, the user checks the shortage of water through the warning sound and the blinking of the LED blinking lamp 91 of the warning part 9 and refills the hydrogen-oxygen mixture gas generation water tank 10 with water.

The preferred embodiments of the present invention have been disclosed in the specification and drawings. In the description of the present invention, special terms are used not to limit the present invention and the scope of the present invention as defined in claims, but just to explain the present invention. Therefore, persons skilled in the relevant art can appreciate that many modifications and variations are possible in light of the above teachings. It is therefore intended that the scope of the invention be limited not by this detailed description, but rather by the claims appended hereto.

What is claimed is:

1. A hydrogen-oxygen mixture gas producing and supplying device comprising:

a hydrogen-oxygen mixture gas generation water tank (10) to store a given amount of water therein and adapted to locate positive and negative electrode plates (3*a* and 3*b*) adapted to electrolyze the water using positive and negative currents;

a top cover (11) mounted on top of the hydrogen-oxygen mixture gas generation water tank (10) to open and close the top of the hydrogen-oxygen mixture gas generation water tank (10) and having a water inlet pipe (110) coupled thereto;

a bottom cover (12) mounted on bottom of the hydrogen-oxygen mixture gas generation water tank (10) and having an extension wall (121) extending from the outer periphery thereof and a bottom sealing plate (122) to form an installation space (12*a*) in which a power supply and control part (5) is mounted to apply the positive and negative currents to the positive and negative electrode plates (3*a* and 3*b*); and a hydrogen-oxygen mixture gas producer (2*a*) fixedly supported vertically to the bottom cover (12) inside the hydrogen-oxygen mixture gas generation water tank (10), while being submerged in the water stored in the hydrogen-oxygen mixture gas generation water tank (10), and having the positive and negative electrode plates (3*a* and 3*b*) alternately stacked on top of one another, while having a given distance vertically therebetween, to perform electrolysis for the water stored in the hydrogen-oxygen mixture gas generation water tank (10), with the positive current applied from a bolt (7*a*) to which the positive current is applied from the power supply and control part (5) and the negative current applied from a bolt (7*b*) to which the negative current is applied from the power supply and control part (5), and to thus produce hydrogen ($H_2$) and oxygen ($O_2$), wherein the plurality of positive and negative electrode plates (3*a* and 3*b*) each has a sectional area of the shape of "/\" or "\/" between an outer periphery (31) and a center opening (32) and a plurality of round bent portions (30) continuously formed concentrically between the outer periphery (31) and the center opening (32) at given intervals so as to enlarge an electrolysis area.

2. The device according to claim 1, wherein the top cover (11) of the hydrogen-oxygen mixture gas generation water tank (10) comprises a hydrogen-oxygen mixture gas outlet pipe (113) protruding outward therefrom to exhaust the hydrogen-oxygen mixture gas produced through the electrolysis operation of the plurality of positive and negative electrode plates (3*a* and 3*b*).

3. The device according to claim 1, wherein the power supply and control part (5) comprises a power connection terminal (54) fixed to one side of the extension wall (121) of the bottom cover (12), a power plug (51) connected to an electrical outlet to receive power from the outside, a connection wire (52) connected to the power plug (51), and a connection socket (53) disposed on end of the connection wire (52), so that the power received from the outside is applied to the power supply and control part (5) disposed inside the installation space (12*a*).

4. The device according to claim 1, further comprising a plurality of permanent magnets (9*a* and 9*b*) built spaced apart from each other by a given distance in the underside of the bottom cover (12) so as to allow magnetic fields generated therefrom to flow to the water stored in the hydrogen-oxygen mixture gas generation water tank (10).

5. The device according to claim 1, wherein the hydrogen-oxygen mixture gas producer (2*a*) comprises a plurality of fixing flanges (33 and 34) protruding symmetrically from each electrode plate, top and bottom support plates (6*a* and 6*b*), and four bolts (7*a*, 7*b*, 7*c*, and 7*d*) passing through the four corners of the top and bottom support plates (6*a* and 6*b*) and screw-coupled to the top and bottom support plates (6*a* and 6*b*), and the two bolts (7*a* and 7*b*) of the four bolts (7*a*, 7*b*, 7*c*, and 7*d*) pass through the bottom cover (12) and enter the installation space (12*a*), whereas the remaining bolts (7*c* and 7*d*) are supported against top of the bottom cover (12) or fitted to concave grooves formed to a given depth on top of the bottom cover (12).

6. The device according to claim 5, wherein the bolt (7*b*) passes through the fixing flanges (33) protruding from the plurality of positive electrode plates (3*a*), and the bottom end of the bolt (7*b*) is connected to a positive connection terminal (57) for applying the positive current, wherein the bolt (7*a*) passes through the fixing flanges (34) protruding from the plurality of negative electrode plates (3*b*), and the bottom end of the bolt (7*a*) is connected to a negative connection terminal (58) for applying the negative current.

7. The device according to claim 1, further comprising a water level control sensor part (4) adapted to allow a warning sound to be generated or to allow an LED blinking lamp (91) to operate, when the storage level of the water stored in the hydrogen-oxygen mixture gas generation water tank (10) is lower than a preset level so as to notify a user of the shortage of water.

8. The device according to claim 5, wherein the hydrogen-oxygen mixture gas producer (2*a*) comprises a plurality of cover plates (8*a*, 8*b*, 8*c*, and 8*d*) fixedly attached to four sides between the four bolts (7*a*, 7*b*, 7*c*, and 7*d*) to hide the plurality of positive and negative electrode plates (3*a* and 3*b*) stacked on top of one another while having the given distances from one another vertically from the outside and to provide advertising printing surfaces thereon to represent all kinds of explanations or advertising words or drawings.

9. The device according to claim 7, wherein the water level control sensor part (4) is electrically connected to the power supply and control part (5) and adapted to sense whether the storage level ($W_1$) of the water stored in the hydrogen-oxygen mixture gas generation water tank (10) is lower than top of the hydrogen-oxygen mixture gas producer (2*a*), and a warning part (9) is mounted inside the installation space (12*a*) to generate the warning sound or operate the LED blinking lamp (91) according to the sensed result.

* * * * *